United States Patent [19]

Lorenz

[11] 4,127,999

[45] * Dec. 5, 1978

[54] GRIPPING ARRANGEMENT

[75] Inventor: Horst Lorenz, Solingen, Fed. Rep. of Germany

[73] Assignee: Th. Kieserling & Albrecht, Solingen, Fed. Rep. of Germany

[ * ] Notice: The portion of the term of this patent subsequent to Sep. 20, 1994, has been disclaimed.

[21] Appl. No.: 809,937

[22] Filed: Jun. 24, 1977

Related U.S. Application Data

[63] Continuation-in-part of Ser. No. 641,188, Dec. 16, 1975, Pat. No. 4,048,833.

[30] Foreign Application Priority Data

Dec. 19, 1974 [DE] Fed. Rep. of Germany ..... 2460168

[51] Int. Cl.[2] ..... B21C 1/14; B21C 1/28

[52] U.S. Cl. ..... 72/290; 226/112

[58] Field of Search ..... 72/287, 290; 226/112

[56] References Cited

U.S. PATENT DOCUMENTS

| | | | |
|---|---|---|---|
| 1,321,729 | 11/1919 | Friel | 72/287 |
| 2,392,609 | 1/1946 | Newman | 226/112 X |
| 3,549,072 | 12/1970 | Ito | 226/112 |
| 3,583,268 | 6/1971 | Scribner | 226/112 |
| 3,844,152 | 10/1974 | Peytavin | 226/112 |
| 3,881,339 | 5/1975 | Mannell | 72/290 |

*Primary Examiner*—Michael J. Keenan

*Attorney, Agent, or Firm*—Michael J. Striker

[57] ABSTRACT

A gripping arrangement for longitudinally advancing elongated workpieces, particularly for use in a drawing bench, a stripping machine and the like, comprises a pair of supports which are mounted on guide rails for movement in paths which are parallel to one another and to the direction of advancement of the workpiece, and co-extensive. Jaw elements are mounted on the supports for movement therewith and for displacement between closed positions in which they engage, and open positions in which they are disengaged from, the workpiece. The gripping arrangement is located downstream of a die and operates in such a manner that always at least one pair of the jaw elements associated with one of the supports engages the workpiece and advances the same in a given direction, thus drawing the workpiece through the die. While one of the supports with its jaw elements draws the workpiece through the die, the other support with its jaw elements in their open positions returns to the upstream end of its path past the one support and its associated closed pair of jaws. The jaw elements of each of the supports extend beyond the support toward the path of movement of the other support, but the jaw elements of the two supports do not interfere with one another when at least one pair of the jaw elements is in the open position thereof. The two supports are independently driven into movement in their paths so that the speed and direction of movement of each support can be selected independently of the speed and direction of movement of the other support.

11 Claims, 5 Drawing Figures

GRIPPING ARRANGEMENT

CROSS-REFERENCE TO RELATED APPLICATION

This is a continuation-in-part of my earlier patent application Ser. No. 641,188, filed Dec. 16, 1975, now U.S. Pat. No. 4,048,833.

BACKGROUND OF THE INVENTION

The present invention relates to a gripping arrangement in general, and more particularly to a gripping device for use in machines for treating elongated workpieces, such as draw benches, stripping machines and similar arrangements.

There are already known various gripping arrangements for use in drawing or stripping machines and, generally speaking, they include a plurality of jaw elements which sequentially close around the workpiece and advance the workpiece in a predetermined direction, thus drawing the workpiece through a die. Among the known gripping arrangements, there are already such in which two supports are guided on rails or similar guiding arrangements for reciprocation in and opposite to the direction of advancement of the workpiece, which supports are equipped with jaw elements, such jaw elements being mounted on their respective supports for movement generally in the radial direction of the workpiece between a closed and an open position thereof for engaging and disengaging the workpiece.

Some of the important problems which are to be solved when drawing long or endless workpieces through a die or out of a treating machine are, on the one hand, to obtain high throughput of the drawing arrangement and of the gripping arrangement and, on the other hand, to obtain a uniform drawing speed despite the fact that the drawing force is exerted upon the workpiece by one support and its associated jaw elements for part of the operating cycle, and by the other support and its associated jaw elements for another part of the cycle. A further requirement which must be satisfied in connection with such a gripping or drawing arrangement is that it be simple, economical and reliable.

To solve the above problems and to satisfy the above requirements, it has been already proposed to provide a gripping arrangement for use in a drawing machine, which gripping or drawing arrangement includes only a single tensioning support which draws the workpiece through the die as it moves in one direction away from the die, whereas the tensioning support is returned to its initial position in the opposite direction at an increased speed in order to keep the intervening time periods between successive drawing operations to a minimum. It will be appreciated that this arrangement operates on an intermittent basis, which is not objectionable in some instances. Inasmuch as substantial forces are applied to and transmitted by the tensioning support to the workpiece being drawn, the tensioning support usually has a substantial weight and, consequently, a high inertia. The high inertia of the tensioning support determines the upper limit to the increase in the speed of return movement of the tensioning support. Thus, this type of an arrangement is not suited for many applications.

There are also already known many different constructions of gripping, tensioning and drawing arrangements which utilize caterpillar-like advancing devices in which the workpiece is gripped between jaws which are arranged on a pair of caterpillar-like conveyors which run at the same speed and also in the same direction in the region of engagement with the workpiece. It will be appreciated that this type of an arrangement is very complex and expensive, particularly because of the need for a precise synchronization of the advancement of the two conveyors, and the need for providing the plurality of the gripping jaws, which must be precisely machined to cooperate with one another, on the two conveyors so that only less than a half of the gripping jaws is in engagement with the workpiece being drawn at any given moment.

In a further prior art construction, there is provided a drawing or gripping arrangement which includes two tensioning supports mounted for movement on guiding rails in such a manner that one of the tensioning supports is arranged behind the other tensioning support when viewed in the direction of advancement or drawing of the workpiece. Because of this successive arrangement of the two tensioning supports, each of the supports is capable of drawing the workpiece through a distance which approximately corresponds to half the length of the guiding rails, whereupon the other tensioning support takes over and the first tensioning support returns to its initial position, the same procedure being followed for the other tensioning support. This results in a drawing machine, or a gripping and drawing arrangement therefor, the guide rails of which are extremely long.

SUMMARY OF THE INVENTION

Accordingly, it is a general object of the present invention to avoid the disadvantages of the prior art.

More particularly, it is an object of the present invention to provide a gripping arrangement for advancing elongated workpieces longitudinally thereof which is capable of advancing the workpieces at a constant speed.

It is yet another object of the present invention to provide a gripping arrangement which is simple in construction and reliable in operation.

A concomitant object of the present invention is to provide a gripping arrangement for use in a drawing machine which draws the workpiece through a die at a constant speed and on a continuous basis.

Still another object of the present invention is to provide a gripping arrangement including two supports which can move in opposite directions without interfering with one another.

In pursuance of these objects and others which will become apparent hereafter, one feature of the present invention resides, in a gripping arrangement for advancing elongated workpieces longitudinally thereof, briefly stated, in a combination which comprises elongated guide means; a pair of supports mounted on the guide means for movement longitudinally thereof in parallel and coextensive paths; jaw means mounted on each of the supports for movement therewith and for displacement between a closed position in which the jaw means engages a workpiece, and an open position in which the jaw means is disengaged from the workpiece; and means for so sequentially operating the supports and the jaw means that, at any given instant, at least one of the jaw supports moves in an advancement direction with the jaw means in the closed position, followed by a return movement in an opposite direction with said jaw means in the open position.

A further concept of the present invention resides, in a machine for treating elongated workpieces, such as a drawing bench, a stripping machine and the like, in a combination which comprises a die having an opening for passage of a workpiece therethrough in a predetermined direction; elongated guide means arranged downstream of the die and extending parallel to said direction; a pair of supports mounted on the guide means for movement longitudinally thereof in parallel and coextensive paths; jaw means mounted on each of the supports for movement therewith and for displacement between open and closed positions; and means for so sequentially operating the supports and the jaw means that the jaw means of each respective support closes and engages the workpiece immediately downstream of the die and draws the workpiece through the die during the movement of the respective support in said direction, whereas the other respective support opens and disengages the workpiece upon reaching a downstream end of its path and conducts return movement opposite to said direction, and vice versa.

According to a currently preferred embodiment of the present invention, the jaw means of each of the supports includes a pair of jaw elements which substantially completely surround a portion of the workpiece when in the closed position thereof. In a further currently preferred embodiment of the present invention, the jaw elements of a respective support extend beyond the support in direction toward the path of movement of the other support and, consequently, toward the workpiece which is located between the supports. At least when both pairs of the jaw elements, that is the jaw elements which are associated with both of the supports, are in their closed positions, which occurs when one of the pairs of jaw elements takes over the drawing function from the other pair of jaw elements, the free ends of the jaw elements point in opposite directions transversely of the elongation of the workpiece and also transversely of the paths of movement of the supports.

The jaw elements are so constructed as not to interfere with the movement of each other or of the supports, the former when at least one pair of the jaw elements is in its open position, the latter under all circumstances. Thus, when one pair of jaw elements is in its open position, the supports and the jaw elements associated therewith can bypass one another without interference.

Each of the supports has a separate drive so that the speed and the direction of movement of each of the supports can be controlled individually and independently of the speed and direction of movement of the other support. However, the movements of the two supports are so coordinated as to assure faultless continuous drawing of the workpiece through the die. In view of the independence of the speeds of movement of the two supports, not only can the returning support move at a quicker pace than the advancing or drawing support, but also both supports can move, for a limited period of time, in the same advancing direction, with the jaw elements closed around the workpiece, at the same or at different speeds whereby taking over of the workpiece by one pair of jaw elements from another pair of jaw elements is facilitated.

It is proposed by the present invention to mount the jaw elements on their associated supports for pivoting, and to provide a drive for each pair of jaw elements, the drive having a moving element which is connected to the jaws of its associated pair by means of connecting links which are pivoted to the jaw elements and to the moving member, respectively. However, it is also proposed according to the present invention to construct the jaws as essentially L-shaped elements which are guided in the respective support for displacement in direction normal to the direction of advancement of the workpiece, each of the L-shaped elements having a portion which extends transversely of the workpiece and which can be moved toward and away from the workpiece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
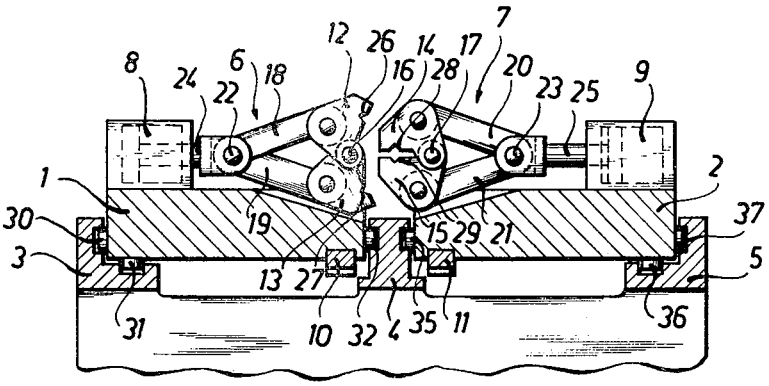
FIG. 1 is a partly sectioned end view of a pivotable gripping arrangement of the present invention when considered in direction of advancement of the workpiece.

Referring now to the drawings, and first to FIG. 1 thereof, it may be seen therein that the advancing and drawing pivotable gripping arrangement of the present invention includes two supports 1, 2 which are mounted on guide rails 3, 4 and 5 and each of which includes gripping units which are designated in toto with reference numerals 6 and 7. The two supports 1 and 2 are similar in construction to one another so as to be interchangeable with one another. The support 1 is equipped with the gripping unit 6, while the support 2 carries the gripping unit 7. The gripping units 6 and 7 are also one like the other so that there is no difference between the construction of the support 1, together with its accessories, from that of support 2 with the accessories thereof.

Cylinder-and-piston units 8 and 9 of conventional constructions are mounted on the supports 1 and 2, respectively, and they are connected with the gripping units 6 or 7. Reference numerals 10 and 11 designate toothed racks each of which is associated with one of the supports 1 and 2 and each of which constitutes part of a conventional drive, such as a rack and pinion drive, for the respective support 1 or 2.

Each of the gripping units 6 and 7 includes a pair of jaw elements 12 and 13 for the gripping unit 6, 14 and 15 for the gripping unit 7. Each pair of the jaw elements 12, 13; 14, 15 is interconnected by means of pivots 16 or 17. Each pivot 16 or 17 is supported in bearings 43, 44, on the one hand, and 45, 46, on the other hand. The bearings 43, 44; 45, 46 are rigidly and stationarily connected with the respective supports 1 or 2. Connecting links 18, 19; 20, 21 are pivotably connected to the respective jaw elements 12, 13; 14, 15. The jaw elements 12, 13; 14, 15 have clamping depressions 26, 27; 28, 29, and the jaw elements are so constructed, and the links 18, 19; 20, 21 are so pivoted thereto, that the depressions 26, 27; 28, 29 are located at the free ends of the jaw elements 12, 13; 14, 15. In this manner, the clamping force is applied by the jaw elements 12, 13; 14, 15 at points which are outwardly spaced from the pivots 16, 17.

The two connecting links 18, 19; 20, 21 of each of the gripping units 6, 7 are pivotally connected to a piston rod 24, 25 of the respective cylinder-and-piston unit 8, 9 by means of pivot bolts 22 and 23, respectively. As a result of this above-discussed arrangement and configuration of the various elements constituting the gripping units 6 and 7, movement of the respective piston rod 24 or 25 in one direction results in closing of the jaw elements 12, 13; 14, 15, while movement of the piston rod 24 or 25 in the opposite direction results in opening of the jaw elements 12, 13; 14, 15.

Figure 2:
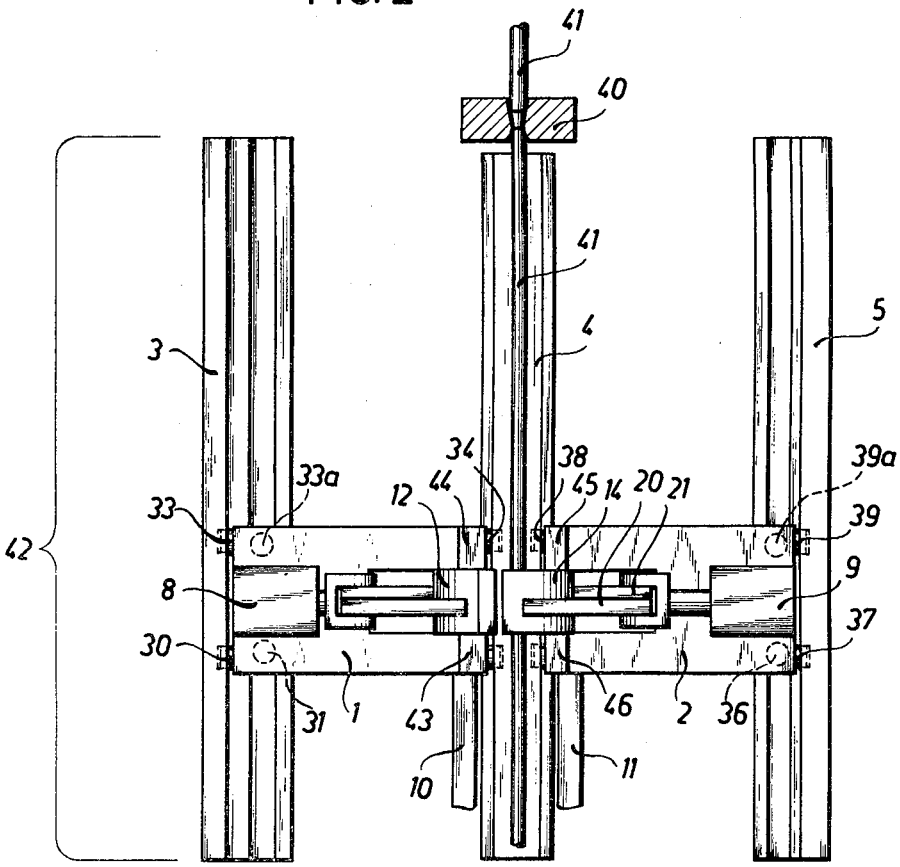
FIG. 2 is a top plan view of the arrangement of FIG. 1.

A comparison of FIGS. 1 and 2 will indicate that the supports 1 and 2 are equipped with guiding rollers **30, 31, 32, 33, 33*a*, 34; 35, 36, 37, 38, 39, 39*a*, which guiding rollers are guided in guide recesses of the guide rails 3, 4, 5 for movement of the supports 1 and 2 in the advancement direction of a workpiece 4'. The guide rails 3, 4 and 5 for each of the supports 1 and 2 extend over the entire advancement distance 42 of the machine in which the present arrangement is used, the guide rails 3, 4 and 5 being parallel with one another and also with the workpiece 41, as illustrated in FIG. 2**.

FIG. 2 also shows that, at this particular stage of operation of the arrangement, the jaw elements 14 and 15 are closed around the workpiece 41 so that the support 2 draws the workpiece 41 through a die 40. On the other hand, the jaw elements 12 and 13 are in their open positions, and the support 1 is on its way toward the die 40. The two supports 1 and 2 pass each other without interference. Similarly, the open jaw elements 12 and 13 pass the closed jaw elements 14 and 15 without interfering with the movement thereof. This non-interference is particularly due to the fact that the depressions 26, 27; 28, 29 of the jaw elements 12, 13; 14, 15 are arranged at the free ends of the jaw elements 12, 13; 14, 15.

In view of the fact that each of the supports 1, 2 is equipped with its separate toothed rack 10 or 11 which forms a part of a separate, non-illustrated, conventional drive, the speeds of the supports 1 and 2 can be individually controlled, particularly during the transition period when one of the supports 1 and 2 approaches the end of the guide rails 3, 4 and 5 which is remote from the die 40 while the other support 1, 2 is located proximate to the die 40. During the transition phase of operation of the arrangement, both gripping units 6 and 7 engage the workpiece 41 for a short period of time. During such transition phase, the supports 1 and 2 and thus the gripping units 6 and 7 associated therewith may move either at the same speed, or at different speeds, in the advancement direction to facilitate transfer of the workpiece from one pair 12, 13 of jaw elements to the other pair 14, 15 of jaw elements, and vice versa. This, of course, results in uniform drawing of the workpiece 41 through the die 40. Always when one of the supports 1 and 2 individually draws the workpiece 41 by its respective gripping unit 6 or 7, the other support 1, 2 moves at high speed in direction toward the die 40.

The present invention also contemplates, instead of pivotally mounting the jaw elements 12, 13; 14, 15 on the supports 1 and 2, to construct the jaws as generally L-shaped elements, and to mount the L-shaped elements on the respective supports 1 and 2 for movement transversely of the drawing direction of the workpiece 41. In this event, the L-shaped elements will move radially toward and away from the workpiece into and out of engagement therewith, and the open L-shaped elements will pass radially outwardly of the closed L-shaped elements.

Figure 3:
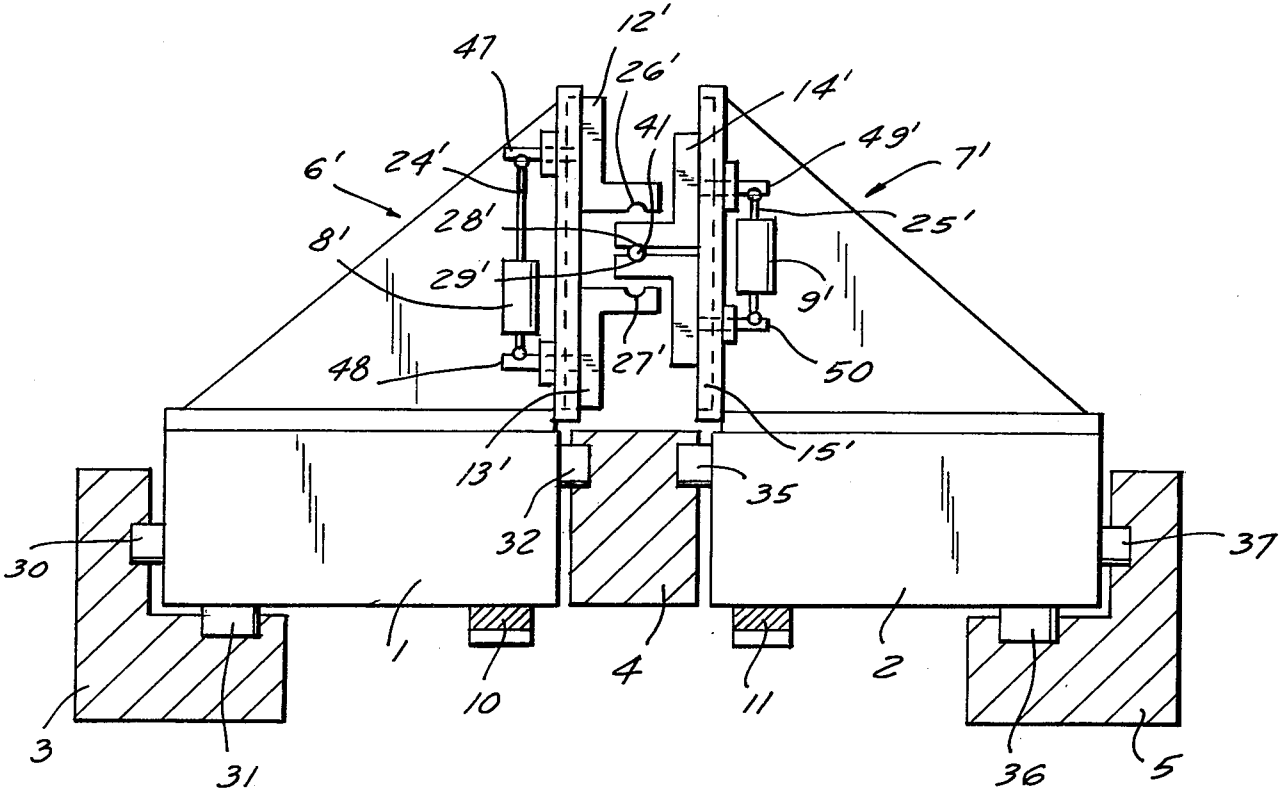
FIG. 3 is a view similar to FIG. 1 but of a linearly displaceable gripping arrangement.

An example of a gripping arrangement which operates according to this principle is illustrated in FIG. 3 of the drawing. All parts of the arrangement which are the same as or similar to those illustrated in and discussed above in connection with FIGS. 1 and 2 have retained their reference numerals. On the other hand, those parts which are similar in function but different in configuration and displacement have been designated with the same reference numerals as the corresponding parts of FIGS. 1 and 2, but supplemented with a prime.

In this gripping arrangement, the supports 1 and 2 are again mounted on the guide rails 3, 4 and 5 for movement longitudinally thereof, by means of guiding rollers of which rollers 30, 31 32, 35, 36 and 37 have been illustrated. The longitudinal movement is again accomplished with the aid of the toothed racks 10 and 11.

On the other hand, the gripping arrangements 6' and 7' proper are different from those appearing in FIGS. 1 and 2. The jaw pairs 12', 13'; 14', 15' have the above-discussed L-shaped configurations and have respective clamping depressions 26', 27'; 28', 29'. The L-shaped jaws 12', 13'; 14', 15' are mounted on the respective supports 1 and 2 for straight-line displacements transversely of the workpiece 41 between the open position momentarily assumed by the jaws 12', 13' and the closed position momentarily assumed by the jaws 14', 15'. The jaws 12', 13'; 14', 15' are limited to a straight-line motion by any conventional means such as, as illustrated in the drawing, by being mounted on respective pins 47, 48; 49, 50 which are received and guided in vertical slots provided in the supports 1 and 2, respectively.

The displacement of the respective pairs of jaws 12', 13', on the one hand and 14', 15', on the other hand may be accomplished in a variety of ways. As illustrated, the displacement is achieved by respective cylinder-and-piston units 8' and 9' the cylinders of which are respectively connected to the pins 48 and 50 so as to be stationary relative thereto. On the other hand, the piston rods 24' and 25' of the units 8' and 9' are connected to the pins 47 and 49.

In the illustrated embodiment, the displacement of the jaws 12', 13'; 14', 15' is sequential in that, when moving toward the closed position, the upper jaws 12', 14' will move first when the respective piston rod 24', 25' is retracted, until they abut against the workpiece 41, after which further retraction of the respective piston rod 24', 25' will result in the lifting of the respective lower jaw 13', 15' toward the closed position. Contrary thereto, when being displaced toward the open positions, the lower jaws 13', 15' will be lowered first due to gravity, and only then the jaws 12', 14' will be lifted.

However, it is also possible to provide the respective unit 8', 9' with two pistons and two piston rods extending to opposite sides of the cylinder of the respective unit 8', 9', the piston rods then being connected to the pins 47, 48; 49, 50, respectively. Under these circumstances, the cylinders of the respective units 8', 9' will be stationarily mounted on the respective supports 1 and 2 so that the cylinder of the respective unit 8' and 9' will not have to be lifted during the closing of the jaws 12', 13'; 14', 15', or lowered during the opening of the jaws 12', 13'; 14, 15'. This possibility has not been illustrated inasmuch as such modification can easily be accomplished with reference to the previous description thereof. Another possibility is to provide an additional abutment for the lower jaws 13' and 15', which will maintain the respective jaw 13', 15' in the desired position. In addition thereto, resort may also be had to a centering arrangement of the type illustrated, for instance, in U.S. Pat. Nos. 3,738,557 or 3,727,772.

Figure 4:
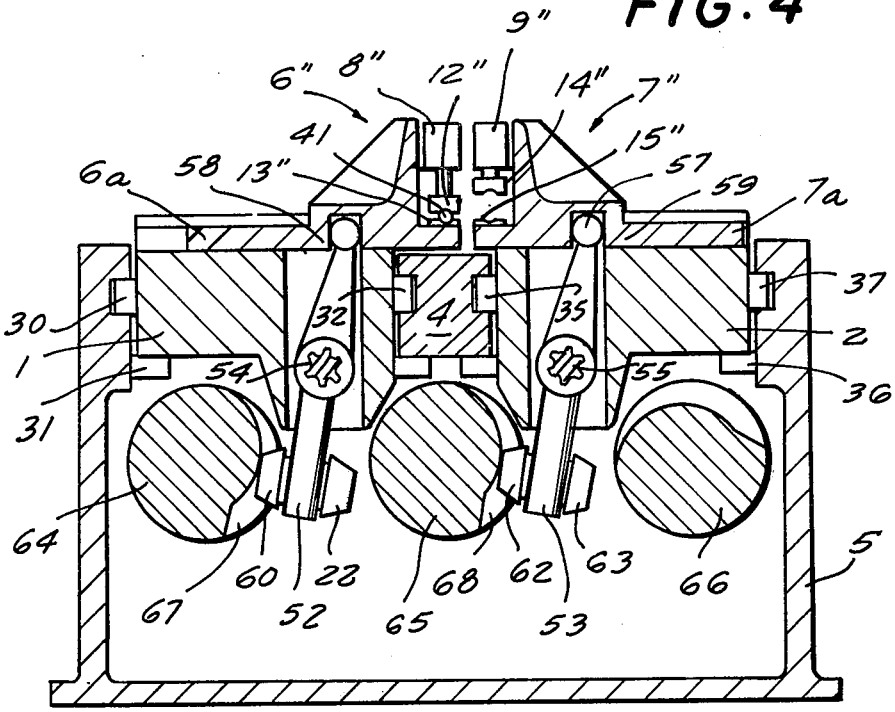
FIG. 4 is a view similar to FIG. 1 but of another linearly displaceable gripping arrangement.
Figure 5:
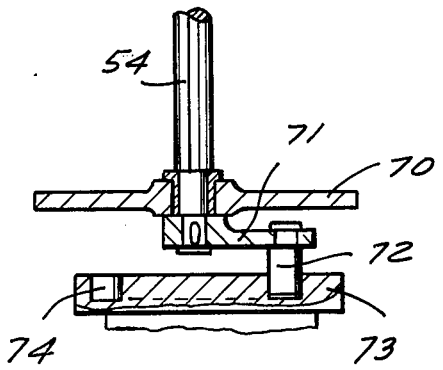
FIG. 5 is a fragmentary sectional view of a displacing device which can be used in the gripping arrangement of FIG. 4.

FIGS. 4 and 5 illustrate a further development of the basic concept of the present invention, and here again the same reference numerals have been used for the same parts, and the same reference numerals supplemented with double primes have been used for functionally similar parts which perform different movements than those illustrated in FIGS. 1 and 2.

In this modified embodiment, the jaws 12", 13"; 14", 15" of the respective gripping arrangements 6" and 7" proper are mounted on respective carriages 6a and 7a which, in turn, are mounted on the supports 1 and 2 for movement in transverse directions and horizontally as illustrated in FIG. 4. The jaws 13" and 15" are mounted on the respective carriages 6a and 7a so as to be stationary relative thereto, while the jaws 12" and 14" are mounted on the respective carriages 6a and 7a for displacement relative thereto toward and away from the jaws 13" and 15" in transverse directions and vertically as seen in FIG. 4, by means of the respective cylinder-and-piston units 8" and 9". The supports 1 and 2 are again mounted for movement longitudinally of the workpiece 41 on rails 3 and 5 which form a part of a casing 51, and on a rail 4 rigid with the casing 51, by means of rollers of which rollers 30, 31, 32, 35, 36 and 37 have been illustrated.

The transverse movement of the carriages 6a and 7a relative to the support 1 and 2 and the longitudinal movement of the latter are accomplished by means of levers 52 and 53, respectively, which are slidably mounted on splined shafts 54 and 55. The levers 52 and 53 are also mounted on the support 1 and 2, respectively, for tilting relative thereto about the respective splined shafts 54 and 55, and for joint movement therewith along the latter. End portions 56 and 57 of the levers 52 and 53 are respectively received in depressions 58 and 59 of the carriages 6a and 7a, and are of rounded configurations as shown in FIG. 4.

The levers 52 and 53 are provided, at their other end portions, with cam follower members 60, 61; 62, 63, such as rollers of preferably conical configurations, which sequentially and selectively operate with respective spindles 64, 65 and 66 in a manner which will be discussed below. The spindles 65, 65 and 66 are turned in synchronism with one another and cause the carriages 6a and 7a to sequentially move in the desired manner and in correlation to the longitudinal displacement of the supports 1 and 2 and displacement of the jaws 12" and 14" between their open and closed positions. The spindles 64, 65 and 66 extend over the length of the casing 51 and are provided with cam recesses 67, 68 and 69, respectively, in which the cam followers 60, 61; 62, 63 engage. The cam recesses 67, 68 and 69 preferably extend helically about their respective spindles 64, 65 and 66 so that the turning of the spindles 64, 65 and 66 accompanied by the engagement of the respective cam follower members 60 or 61; 62 or 63 in the respective cam recesses 67, 68 or 69 results in the sliding of the respective levers 52 or 53, and thus in the movement of the respective supports 1 or 2 and the respective carriages 6a or 7a, along the splined shafts 54 or 55, in the advancing or the return direction.

Furthermore, FIG. 5 illustrates a possibility of how the pivoting of the levers 52 and 53 about the splined shafts 54 and 55 could be accomplished. In this modification, a lever 71 is mounted at the end of the splined shaft 54 for joint pivoting, the splined shaft being supported in a wall 70 which is rigid with the casing 51. A pin 72 is mounted at the free end of the lever 71 and is received in an eccentric groove 74 of a disk 73 which is rotated in correlation to the movement of the respective supports 1 and 2. Preferably, a transmission is interposed between the spindles 64, 65 and 66 and the disk 73 so that the spindles 64, 65 and 66, on the one hand, and the disk 73, on the other hand, are rotated in a proportionate synchronism, advantageously in a whole-number multiple. The groove 74 is eccentric with respect to the axis of the splined shaft 54 so that the rotational movement of the disk 73 is converted by the cooperation of the pin 72 with the groove 74 into a reciprocating angular displacement of the lever 72 and thus of the splined shaft 54. Thus, the arrangement of FIG. 5 achieves the cooperation of the levers 52, 53 of FIG. 4 with the respective spindles 64, 65 and 66. In all respects not material for the understanding of the present invention, which have not been discussed here in any detail, this arrangement is conventional.

The operation of the modification of FIGS. 4 and 5 can also be easily ascertained from the drawing. Thus, such operation will only be briefly discussed herein. As mentioned before, the carriages 6a and 7a move jointly with the supports 1 and 2 and, in addition thereto, they perform movements, along a horizontal plane, toward and away from the workpiece 41 with the jaws 12" and 14" in their open positions. When the respective pair 12", 13"; 14", 15" is open and in registry with the workpiece 41, the respective unit 8", 9" can be actuated to displace the respective upper jaw 12", 14" toward its closed position. Once the respective jaw pair 12", 13"; 14", 15" is closed, it can advance the workpiece 41 longitudinally thereof. Upon opening of the jaw pair 12", 13"; 14", 15" by the respective unit 8", 9", the respective carriage 6a, 7a can be retracted outwardly and the other carriage 7a, 6a can be extended inwardly by the pivoting of the respective levers 52, 53 acted upon by the respective splined shafts 54, 55 so that the other jaw pair 14", 15"; 12", 13" can be closed around the workpiece 41. Since the supports 1 and 2 are at or close to the opposite ends of the rails 3, 4 and 5 during the transfer of the workpiece 41 between the jaw pairs 12", 13"; 14", 15", the extension of the respective carriage 7a, 6a and closing of the respective jaws 14", 15"; 12", 13" may and usually will be performed prior to the opening of the respective jaw pair 12", 13"; 14", 15" and retraction of the respective support 6a, 7a. Thus, for a brief period of time, all jaws 12", 13", 14" and 15" will engage the workpiece 41 during such transfer.

The rotation of the disk 73 results, as mentioned previously, in the pivoting of the lever 71 with the splined shaft 54 and thus in pivoting of the lever 52 and, for instance, in a disengagement of the cam follower member 60 from the cam recess 67 of the spindle 64 and in an engagement of the cam follower member 61 with the cam recess 68 of the spindle 65. Preferably, the spindle 64 is designed for moving the support 1 in the advancement direction, while the spindle 65 returns each of the supports 1 and 2 to its starting position. Thus, the above-mentioned pivoting of the lever 52 results in a switch from an advancing mode to a return mode. Upon termination of the return mode, the disk 73 pivots the lever 71 and thus the lever 52 back into the illustrated position, with attendant switching from the return mode to the advancing mode. The lever 53 will be operated in a similar manner, but with a phase shift with respect to the operation of the lever 52, determined by the phase shift between the disks 73 controlling the pivoting of the respective levers 52 and 53. The rotation of the disks 73 and those of the spindles 64, 65 and 66 are so coordinated that the pivoting of the levers 52 and 53 occurs when the respective supports 1 and 2 reach their end positions relative to the shafts 54 and 55.

Thus, it may be seen that the modifications of FIGS. 3 to 5 utilize the concept of linear displacement of the jaws into and out of engagement with the workpiece to be advanced, and are still capable of avoiding interference with the movement of each other, together with the supports on which they are mounted, when at least one of the jaw pairs is in its open position.

It will be understood that each of the elements described above, or two or more together, may also find a useful application in other types of constructions differing from the types described above.

While the invention has been illustrated and described as embodied in a gripping arrangement used in a drawing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A gripping arrangement for continuously advancing elongated workpieces longitudinally thereof in an advancement path, comprising, in combination, elongated guide means parallel to a section of the advancement path; a pair of supports each mounted on said guide means for reciprocatory movement along the same in a reciprocatory path that is parallel to, offset from, and coextensive with, the advancement path section and the reciprocatory path of the other support; means for reciprocating each of said supports in the respective reciprocatory path thereof in an advancement and a return direction, respectively, past the other support; at least a pair of jaws for each respective support; means for mounting each respective jaw pair on the respective support for displacement relative thereto between a closed and an open position in which said respective jaw pair engages, and is disengaged from, a workpiece, respectively, and for joint reciprocation with said respective support, when in said closed position, in a first path having a path portion about the advancement path section in common with the first path of the other jaw pair, and, when in said open position, in a second path spaced from the advancement path section and from said common path portion; and means for so displacing said jaws of each respective pair between said positions thereof that at least one of said jaw pairs is always in said closed position thereof while moving with the respective support in said advancement direction for engaging and continuously advancing the workpiece, while each of said jaw pairs is in said open position thereof at least while moving with the respective support in said return direction past the other jaw pair for avoiding interference with the movement of the latter by moving in said second path that is outside said common path portion.

2. A combination as defined in claim 1, wherein said guide means includes elongated rails extending parallel to the advancement path.

3. A combination as defined in claim 2, wherein each of said supports includes a plurality of rollers in guiding engagement with said rails.

4. A combination as defined in claim 1, wherein said jaws of each of said supports extend beyond said reciprocatory path of the respective support toward the reciprocatory path of the other support at least when in said closed position.

5. A combination as defined in claim 4, wherein said mounting means mounts said jaws on said supports for linear displacment between said open and closed positions.

6. A combination as defined in claim 4, wherein said means for displacing said jaw pairs between said positions thereof includes a drive for each of said pairs of jaws and having a movable member, and connecting links pivoted to said jaws and to said movable member, respectively.

7. A combination as defined in claim 6, wherein said drive includes a cylinder-and-piston unit having one member stationary relative to the respective support, said movable member being movable with respect to said stationary member.

8. In a machine for treating elongated workpieces, such as a drawing bench, stripping machine and the like, a combination comprising a die having an opening for passage of a workpiece therethrough; and means for continuously advancing the workpiece in an advancement path through said opening of said die, including elongated guide means parallel to a section of the advancement path downstream of said die, a pair of supports each mounted on said guide means for reciprocatory movement along the same in a reciprocatory path that is parallel to, offset from, and coextensive with, the advancement path section and the reciprocatory path of the other support; means for reciprocating each of said supports in the reciprocatory path thereof in an advancement and a return direction, respectively, past the other support; at least a pair of jaws for each respective support; means for mounting each respective jaw pair on the respective support for displacement relative thereto between a closed and an open position in which said respective jaw pair engages, and is disengaged from, the workpiece, respectively, and for joint reciprocation with said respective support, when in said closed position, in a first path having a path portion about the advancement path section in common with the first path of the other jaw pair, and, when in said open position, in a second path spaced from the advancement path section and from said common path portion; and means for so displacing said jaws of each respective pair between said positions thereof that at least one of said jaw pairs is always in said closed position thereof while moving with the respective support in said advancement direction for engaging the workpiece and continuously advancing the same through said opening of said die, while each of said jaw pairs is in said open position thereof at least while moving with the respective support in said return direction past the other jaw pair for avoiding interference with the movement of the latter by moving in said second path that is outside said common path portion.

9. A combination as defined in claim 8, wherein said advancing means includes means for independently moving said supports in said advancing and return directions.

10. A combination as defined in claim 9, wherein both of said supports move in said advancing direction with said jaw pairs thereof in said closed positions during the initial movement of a respective support away from the upstream end of its reciprocatory path.

11. A combination as defined in claim 10, wherein said supports move at different speeds in said advancing direction during said initial movement.

* * * * *